US009970335B2

(12) United States Patent
Boese et al.

(10) Patent No.: US 9,970,335 B2
(45) Date of Patent: May 15, 2018

(54) CAMSHAFT ADJUSTER HAVING A HYDRAULIC CHAMBER SEALING ELEMENT THAT CAN BE SWITCHED TO AND FRO TO ACHIEVE HYDRAULIC FREEWHEELINGT PART

(71) Applicant: Schaeffler Technologies AG & Co. KG, Herzogenaurach (DE)

(72) Inventors: Olaf Boese, Nuremberg (DE); Jochen Thielen, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 15 days.

(21) Appl. No.: 15/309,370

(22) PCT Filed: Jan. 21, 2015

(86) PCT No.: PCT/DE2015/200012
§ 371 (c)(1),
(2) Date: Nov. 7, 2016

(87) PCT Pub. No.: WO2015/169292
PCT Pub. Date: Nov. 12, 2015

(65) Prior Publication Data

US 2017/0081991 A1 Mar. 23, 2017

(30) Foreign Application Priority Data

May 8, 2014 (DE) ..... 10 2014 208 598

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34453* (2013.01); *F01L 2001/34479* (2013.01)

(58) Field of Classification Search
CPC ..... F01L 1/3442; F01L 1/047; F01L 2001/34453; F01L 2001/34479
See application file for complete search history.

(56) References Cited

U.S. PATENT DOCUMENTS 5,813,316 A 9/1998 Sekiya et al.
6,058,897 A 5/2000 Nakayoshi
(Continued)

FOREIGN PATENT DOCUMENTS

DE 19914767 A1 10/1999
DE 19922194 6/2000
(Continued)

*Primary Examiner* — Zelalem Eshete
(74) *Attorney, Agent, or Firm* — Davidson, Davidson & Kappel, LLC

(57) ABSTRACT

A camshaft adjuster for an internal combustion engine of a motor vehicle, having a stator and a rotor accommodated inside the stator such that the rotor can rotate relative to said stator, wherein the rotor has at least one rotor vane, which extends in the radial direction towards an inner wall of the stator and forms a first hydraulic chamber and a second hydraulic chamber between the stator and the rotor, wherein a connection gap remains between a rotor vane end face and the inner wall of the stator and fluid-connecting the first hydraulic chamber and the second hydraulic chamber. A sealing element is guided in a radially movable manner in the rotor vane end face to and fro between a sealing position, in which the sealing element bears against the inner wall of the stator to seal off the connection gap, and a connecting position, in which the first and second hydraulic chambers are connected to each other through the connecting gap.

10 Claims, 6 Drawing Sheets

(56) References Cited

U.S. PATENT DOCUMENTS

| | | | | |
|---|---|---|---|---|
| 6,237,466 | B1 | 5/2001 | Fukuhara et al. | |
| 6,374,785 | B1 | 4/2002 | Schaefer et al. | |
| 6,412,463 | B1 | 7/2002 | Kinugawa | |
| 6,457,448 | B1 | 10/2002 | Dietz | |
| 6,679,208 | B2 | 1/2004 | Stephan et al. | |
| 8,342,144 | B2 | 6/2013 | Busse et al. | |
| 8,544,433 | B2 * | 10/2013 | Noguchi | F01L 1/3442 123/90.15 |
| 2007/0113811 | A1 | 5/2007 | Grunow et al. | |
| 2012/0139185 | A1 | 6/2012 | Tomura | |

FOREIGN PATENT DOCUMENTS

| | | |
|---|---|---|
| DE | 19932299 | 1/2001 |
| DE | 19936921 | 2/2001 |
| DE | 102007054547 | 5/2009 |
| DE | 102010025883 | 1/2012 |
| EP | 1339953 B1 | 9/2006 |
| EP | 2072767 | 6/2009 |
| EP | 2631439 | 8/2013 |
| JP | 2014070549 | 4/2014 |
| WO | WO2005113945 | 12/2005 |

* cited by examiner

CAMSHAFT ADJUSTER HAVING A HYDRAULIC CHAMBER SEALING ELEMENT THAT CAN BE SWITCHED TO AND FRO TO ACHIEVE HYDRAULIC FREEWHEELINGT PART

The present invention relates to a camshaft adjuster for an internal combustion engine of a motor vehicle, such as a passenger car, a truck or another type of commercial vehicle, including a stator and including a rotor, which is accommodated within the stator and is rotatably supported relative thereto. The rotor includes at least one rotor vane, which extends in the radial direction to an inner wall of the stator and forms a first hydraulic chamber and a second hydraulic chamber between the stator and the rotor, a (connecting) gap remaining between an end face of the rotor vane and the inner wall of the stator, which fluidically connects the first hydraulic chamber and the second hydraulic chamber to each other.

The operating principle of a camshaft adjuster of this type is based on the fact that the stator is usually connected to the crankshaft of the internal combustion engine with the aid of an endless traction element, such as a camshaft drive chain or a toothed drive belt. The rotor is usually rotatably fixedly connected to the camshaft and may be rotated by its rotatable bearing within the stator with respect thereto within a predetermined angle range for the purpose of thereby changing the timing of the internal combustion engine during its operation. The rotor is rotated with respect to the stator due to a possibly alternating application of pressure to the first and/or the second hydraulic chamber(s) with the aid of a hydraulic fluid, which may be supplied or removed for this purpose, for example via activatable hydraulic valves. As a result of the pressure application, the rotor may be rotated relative to the stator.

For reasons of design or function, however, a (connecting) gap remains upon the accommodation of the rotor within the stator, which fluidically connects the first and the second hydraulic chambers to each other. This (connecting) gap may be unintentionally changed in size, for example due to a hardened (outer) toothing of the stator, since the occurring quench distortion brings about an out-of-round stator or an out-of-round inner wall of the stator. Unless this (connecting) gap is sealed, however, this results in rather undesirable leaks or an undesirable short of the first and the second hydraulic chambers. A corresponding seal may be comparatively favorably achieved with the aid of a sealing element.

Camshaft adjusters for an internal combustion engine are known in various specific embodiments from the prior art, which share the fact that they try to achieve a preferably effective seal of the (connecting) gap remaining between an end face of the rotor vane and the inner wall of the stator.

For example, a device for changing the valve timing of gas exchange valves in an internal combustion engine, in particular a hydraulic camshaft adjusting device of a rotary piston design, is described in DE 199 36 921 A1. This device includes a drive wheel, designed as an outer rotor, which is in drive connection with a crankshaft of the internal combustion engine and which has a cavity formed by a hollow cylindrical circumferential wall and two side walls. At least one hydraulic working chamber is formed in the cavity of the drive wheel by two boundary walls extending from the inside of the circumferential wall and oriented toward the longitudinal central axis of the drive wheel. The device also includes an impeller, designed as an inner rotor, which is rotatably fixedly connected to a camshaft of the internal combustion engine and which is inserted into the cavity of the drive wheel. The impeller has at least one vane on the circumference of its wheel hub, situated in an axial retaining groove, which extends radially into a working chamber of the drive wheel and divides the latter into two oppositely acting hydraulic pressure chambers. Each vane of the impeller is pressed against the inside of the circumferential wall of the drive wheel by its upper end face due to the force of a spring element situated in the axial retaining groove on its lower end face. The pressure chambers effectuate a swivel movement or fixing of the impeller with respect to the drive wheel and thus of the camshaft with respect to the crankshaft upon optional or simultaneous application of pressure with the aid of a hydraulic pressure medium.

To avoid a radial displacement of the vanes against the force of their spring elements as a result of a pressure buildup in the connecting gap between the upper end face of each vane of the impeller and the inside of the circumferential wall of the drive wheel, each vane of the impeller may be radially pressed against the inside of the circumferential wall of the drive wheel by its upper end face, due to the pressure force of the hydraulic pressure medium, which may be introduced in a targeted manner on its lower end face, in addition to the force of its spring element, when pressure is applied to one or both pressure chamber(s) of each hydraulic working chamber.

A similar camshaft adjuster is apparent from DE 199 32 299 A1. A device is described therein for the rotation angle adjustment of a camshaft with respect to the crankshaft of an internal combustion engine, in particular a vane cell adjuster. This device includes an outer rotor driven by the crankshaft and an inner rotor situated coaxially thereto, which is rotatably fixedly connected to the camshaft and has a shared rotation axis with the outer rotor. At least one hydraulic working chamber is provided within the outer rotor, which is divided into a first and a second pressure chamber by a pivoting vane of the inner rotor. The pressure chambers are in flow connection to two annular spaces and are alternately or simultaneously supplied with pressure oil therefrom. The inner rotor has vane receiving grooves for the pivoting vanes, a clearance for vane pressure springs being provided between a groove base of the vane receiving grooves and an underside of the pivoting vanes.

To ensure a preferably tight contact of the pivoting vane on the inner circumference of the outer rotor, pressure oil is applied to the undersides of the pivoting vanes while the internal combustion engine is in operation.

Another camshaft adjuster is known from EP 1 339 953 B1. A device for the relative rotation angle adjustment of a camshaft of an internal combustion engine with respect to a drive wheel is described therein. This device includes an inner part which is rotatably fixedly connected to the camshaft and includes at least approximately radially running webs or vanes and a driven cell wheel, which has multiple cells distributed over the circumference and delimited by webs, which are divided into two pressure chambers by the webs or vanes of the inner part, which are angularly movably guided therein. Upon applying the hydraulic pressure to the two pressure chambers, or relieving the pressure thereof, via control lines, the camshaft is rotatable relative to the cell wheel between two end positions with the aid of the webs or vanes. Sealing elements are situated on the free end faces of the webs or vanes, which are used to seal the two pressure chambers delimited by the webs or vanes or the connecting gap on the free end faces.

To achieve a comparatively effective seal of the two separated pressure chambers with respect to each other, recesses are provided on the end face of the webs or vanes, in which sealing members are situated. These sealing members are pressed against an inner wall of the cell wheel by a hydraulic application for the purpose of sealing the pressure chambers.

Another camshaft adjuster is described in DE 10 2010 025 883 A1, whose rotor includes a number of radially outwardly extending rotor vanes. A sealing element for reducing leaks is positioned in each of the vane ends of the rotor vanes, the sealing elements each being movably supported on the rotor vanes via a radial gap, to which hydraulic medium may be applied, forming a seal in the circumferential direction.

Finally, a camshaft adjuster is apparent from EP 2 072 767 A2, which has sealing elements on its rotor vane end faces, which are continuously pressed against the inner wall or the inside of the stator by a pressurized oil.

However, camshaft adjusters are furthermore known from DE 10 2007 054 547 A1, which include a locking device, which permits a mechanical connection between the rotor and the stator in certain operating states of the internal combustion engine. The locking of the rotor and stator is also designed as a so-called central locking mechanism, in which the latter are connected to each other in the middle of the possible angle range, namely between the particular end stops of the rotor on the stator.

It has been demonstrated in practice that a type of hydraulic freewheeling should be ensured, in particular in a camshaft adjuster having a central locking mechanism. The first and second hydraulic chambers may be fluidically connected to each other, i.e., shorted, for a hydraulic freewheeling of this type. In a camshaft adjuster having a central locking mechanism, control pistons may be inserted for this purpose into the rotor vanes to control a hydraulic freewheeling. These control pistons may be activated by a pressurized hydraulic fluid and/or a pressure spring. The disadvantage is that, due to the use of the control pistons in the rotor vanes, no more installation space remains for sealing elements in or on the rotor vanes. Moreover, it is necessary for cross holes to be present in the rotor vanes to ensure the hydraulic freewheeling, for the purpose of fluidically connecting, i.e. shorting, the first and the second hydraulic chambers to each other as needed. These cross holes are machined and are therefore able to be manufactured only in a comparatively cost-intensive manner.

SUMMARY OF THE INVENTION

An object of the present invention is therefore to eliminate or at least to mitigate the disadvantages of the prior art. In particular, the object is to provide a camshaft adjuster, in which it is structurally possible, using preferably simple means, to combine a preferably effective sealing of the hydraulic chambers with the possibility of a short thereof.

The present invention provides a sealing element, which is radially movably guided within the rotor vane end face, and is optionally switchable back and forth between a sealing position, in which the sealing element rests against the inner wall of the stator, sealing the (connecting) gap, and a connecting position/freewheeling position, in which the first and the second hydraulic chambers are connected to each other by the (connecting) gap. The connecting position is therefore the position in which the two hydraulic chambers of a vane cell are fluidically connected to each other, i.e., a passage of hydraulic medium is permitted/allowed/facilitated between the rotor vane and the inside of the stator.

This means that the sealing element guided in the rotor vane end face is switchable in a targeted manner as needed from a location or position in which the first and the second hydraulic chambers are sealed against each other into a location or position in which the first and the second hydraulic chambers are shorted. In this way, the switchable sealing element performs a dual function. Thus, a reliable and effective sealing of the two hydraulic chambers against each other is possible during normal operation of the camshaft adjuster, in which its rotor is to be rotated with respect to the stator. However, the two hydraulic chambers may be connected to each other or shorted as needed by a targeted switching of the sealing element, so that, for example, a hydraulic freewheeling may also be implemented. It is thus possible to dispense with the use of control pistons or cross holes in the rotor vanes to implement the hydraulic freewheeling.

The sealing element may be designed, for example, as a kind of seal strip, which extends in the axial direction of the camshaft adjuster and is thus able to seal the two hydraulic chambers against each other with the aid of a theoretically linear contact on the inner wall of the stator. The sealing element may be manufactured from an elastic material, such as an elastic plastic or a rubber material.

It is thus advantageous if, for the purpose of switching into the sealing position, the sealing element is displaceable in the direction of the inner wall by a pressure force, applicable to the sealing element, of a hydraulic fluid which may be optionally supplied via a control channel. The control channel makes it structurally easily possible to switch the sealing element in a targeted manner, since a flow of the hydraulic fluid in the control channel may be controlled, for example, by an actuatable hydraulic valve. Hydraulic fluid which is needed for the camshaft adjuster in any case may furthermore be also used for the targeted switching of the sealing element.

For a particularly reliable contact of the switchable sealing element on the inner wall of the stator, it is advantageous if the sealing element is pretensioned in the direction of the sealing position with the aid of a spring. The pretensioning force of the sealing element may be easily increased thereby for the normal operation of the camshaft adjuster.

According to one advantageous embodiment variant of the present invention, for the purpose of switching into the connecting position, the sealing element has at least one active surface in the vicinity of the inner wall of the stator, upon which a counter-pressure force of a pressurized hydraulic fluid from the first and/or the second hydraulic chamber(s) acts. This means that the sealing element is structurally designed in such a way that a hydraulic pressure which prevails in the first and/or the second hydraulic chamber(s) in any case is solely sufficient for switching the sealing element into the connecting position. The hydraulic fluid of the camshaft adjuster may thus also be used to switch the sealing element into the connecting position without requiring an additional actuating device.

To effectively switch the sealing element into the connecting position, it is also advantageous if the at least one active surface is dimensioned and/or geometrically shaped in such a way that the sealing element is displaceable into the connecting position by the counter-pressure force acting upon the active surface during the switching into the connecting position while the rotor is rotating. It is advantageous if this is preferably possible only when no hydraulic fluid generating pressure force is flowing to the sealing element via the control channel. If the sealing element is pretensioned in the direction of the sealing position by an optional spring, it is advantageous if the counter-pressure force is greater than the pretensioning force of the spring.

The at least one active surface situated in the vicinity of the inner wall of the stator may be formed, for example, in that the sealing element is chamfered in this location, i.e., has chamfers. Alternatively, the sealing element may have rounded edges in this location, i.e., it may have radii which then form one or multiple active surfaces. It is also possible that the entire surface has a rounded design on a side of the sealing element facing the inner wall of the stator, so that at least one active surface results. Alternatively, the at least one active surface may also be easily formed by manufacturing-induced bevels, which result during the manufacture of the sealing element. In addition, the at least one active surface may also be formed by a shoulder provided on the sealing element. Regardless of the specific design of the at least one active surface, the latter should facilitate a force application point for the counter-pressure force. The at least one active surface is advantageously dimensioned in such a way that, during the operation of the camshaft adjuster, the counter-pressure force is able to displace the sealing element against the centrifugal force generated by the rotation of the rotor or the stator.

For a preferably effective switching of the sealing element into the sealing position, it is advantageous if the hydraulic pressure of the hydraulic fluid which may be optionally supplied via the control channel is selected or defined in such a way that the sealing element is displaceable into the sealing position against the counter-pressure force. This means that the pressure force for a switching of the sealing element into the sealing position is to be greater than the counter-pressure force acting upon the at least one active surface. This fixing or setting of the hydraulic pressure which is applicable in the control channel as needed may take place via hydraulic valves, pressure regulators or similar hydraulic auxiliary devices.

For a structurally easy radially movable guidance of the sealing element or an easy switching into the connecting position, it is advantageous if the rotor vane end face has a rotor vane groove, into which the sealing element is radially displaceable by the counter-pressure force, if the counter-pressure force is greater than the pressure force and/or a spring force.

It is also advantageous if the rotor vane groove is fluidically connected to the control channel. For example, the control channel may open into the rotor vane groove, so that the optionally applicable hydraulic fluid therein is able to displace the sealing element situated in the rotor vane groove in the direction of the sealing position.

The camshaft adjuster according to the present invention may be particularly advantageously used if the latter includes a locking device, with the aid of which the rotor and the stator are rotatably fixedly connectable to each other. For example, the locking device may be a central locking mechanism, which is actuatable or activatable in certain operating states of the internal combustion engine, for example to avoid vibrations within the camshaft adjuster.

According to one particularly advantageous specific embodiment of the present invention, the rotor is movable into a locking position when the sealing element is switched into the connecting position. In the connecting position of the sealing element, the first and the second hydraulic chambers are fluidically connected to each other, i.e., shorted, so that a hydraulic freewheeling may be implemented.

In other words, the present invention makes it possible to permit an integration of one or multiple sealing elements into a camshaft adjuster and to dispense with cost-intensive control pistons and cross holes in the rotor vanes for the fluidically connecting short between the hydraulic chambers. The sealing elements, which are shaped for example in the manner of a seal strip, perform two functions, namely a sealing of the connection between the hydraulic chambers during normal operation of the camshaft adjuster and, for example, a release of the fluidic connection between the hydraulic chambers during the activation of a central locking function, so that the hydraulic chambers are shorted with respect to each other. This means that a hydraulic freewheeling is ensured without the use of control pistons and cross holes in the rotor vanes.

BRIEF DESCRIPTION OF THE DRAWINGS

The present invention is also explained in greater detail below with the aid of drawings in which different exemplary embodiments are illustrated.

DETAILED DESCRIPTION

Figure 1:
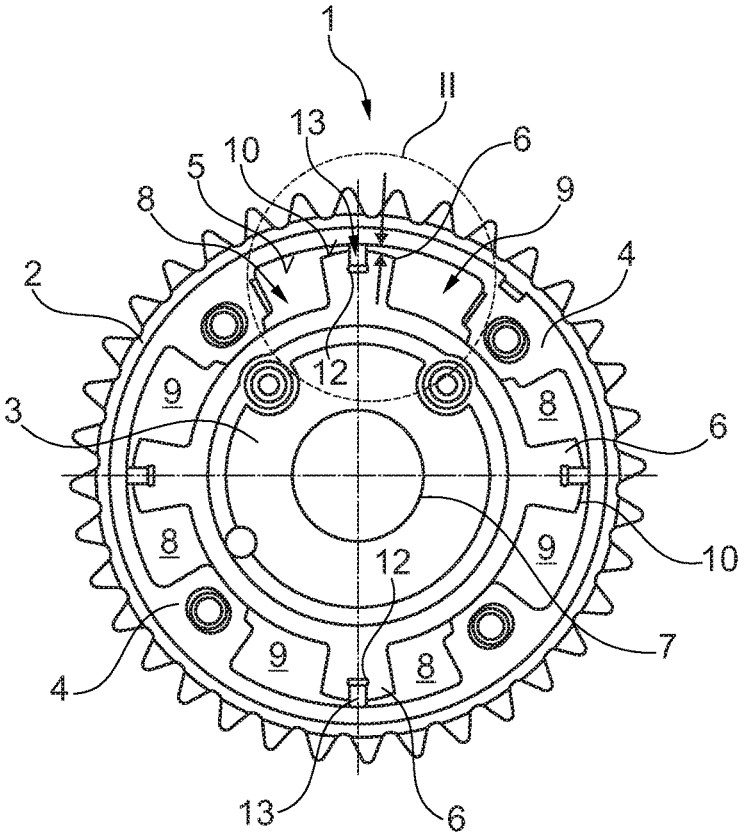
FIG. 1 shows a top view of an only partially illustrated camshaft adjuster, including a stator and a rotor which is accommodated therein in a rotatably supported manner, in whose rotor vane end face a sealing element is situated in a sealing position.

The figures are only of a schematic nature and are used only for the sake of understanding the present invention. Identical elements are provided with identical reference numerals. Features of the individual exemplary embodiments are interchangeable with each other.

FIG. 1 shows a top view of an only partially illustrated camshaft adjuster 1, including an externally toothed stator 2 and including a rotor 3, which is accommodated within stator 2 in a rotatably supported manner relative thereto. Stator 2 and rotor 3 are situated concentrically to each other. A camshaft adjuster 1 of this type is used for the hydraulically effectuated change or adjustment of the timing of an internal combustion engine of a motor vehicle.

It is furthermore apparent in FIG. 1 that stator 2 has a large number of separating webs 4, which extend radially inwardly from an inner wall 5 of stator 2. Rotor 3 furthermore includes a large number of rotor vanes 6, which extend from a hub 7 of rotor 3 in the radial direction to inner wall 5 of stator 2. In this exemplary embodiment, stator 2 includes exactly four separating webs 4. Rotor 3 includes exactly four rotor vanes 6, which are distributed equidistantly from each other over the circumference of rotor 3. In this way, a hydraulic chamber is formed between each of two separating webs 4 of stator 2, which are divided into a first hydraulic chamber/partial vane cell 8 and a second hydraulic chamber/partial vane cell 9 by rotor vane 6 situated therebetween.

It is also apparent from FIG. 1 that a function-specific or design-specific connecting gap 11 remains between a rotor vane end face 10 of each rotor vane 6 and inner wall 5 of stator 2, which fluidically connects first hydraulic chamber 8 and second hydraulic chamber 9 to each other. To seal first and second hydraulic chambers 8, 9 against each other as needed, a sealing element 13 is accommodated in a radially movably supported manner in each rotor vane groove 12. In this exemplary embodiment, sealing element 13 is a seal strip made from an elastic material.

In its position illustrated in FIG. 1, sealing element 13 is situated in a sealing position, in which sealing element 13 rests against inner wall 5 of stator 2, sealing connecting gap 11. This means that the two hydraulic chambers 8 and 9 are largely or completely fluidically separated from each other. This sealing position of sealing element 13 is the preferred position during normal operation of camshaft adjuster 1, if the latter is to change or adjust the timing of the internal combustion engine.

Figure 2:
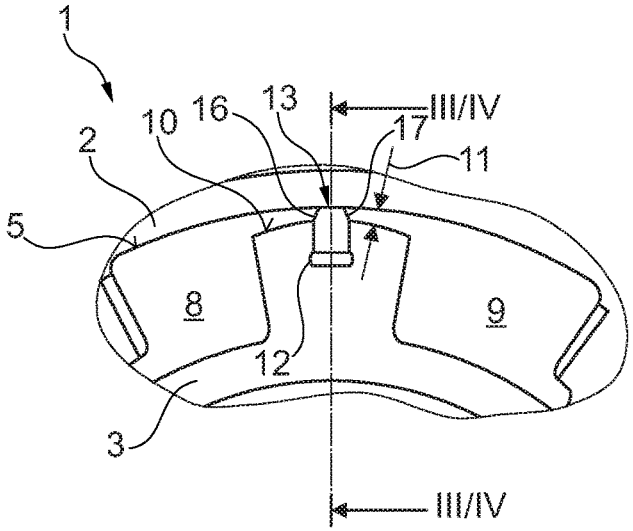
FIG. 2 shows an enlarged partial detail II of the camshaft adjuster from FIG. 1, in which the sealing element is in the sealing position.

It is even more readily apparent from FIG. 2, which illustrates an enlarged partial detail of camshaft adjuster 1 from FIG. 1, that sealing element 13 is situated in the sealing position, in which is rests against inner wall 5 of stator 2, sealing connecting gap 11. For this purpose, it is displaced radially outwardly within rotor vane groove 12 in the direction of inner wall 5 of stator 2.

Figure 3:
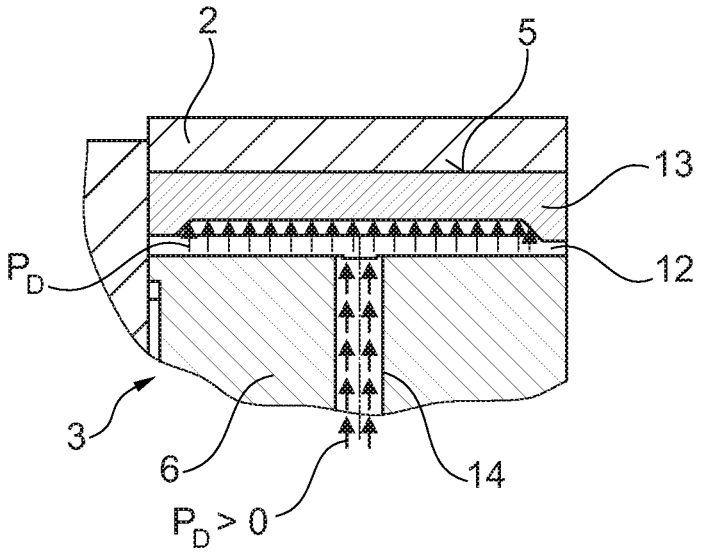
FIG. 3 shows a sectional view of the camshaft adjuster illustrated as a partial detail in FIG. 2 along section line III from FIG. 2, the sealing element being in the sealing position.

It is apparent from FIG. 3, which shows a sectional view of camshaft adjuster 1 illustrated as an enlarged partial detail in FIG. 2 along section line III, that a control channel 14 is formed within each rotor vane 6, which opens into rotor vane groove 12 or is fluidically connected thereto. A hydraulic pressure $p_D$ is also indicated by arrows in FIG. 3, which is effectuated by a pressurized hydraulic fluid, which is suppliable to control channel 14 optionally or as needed. In FIG. 3, this hydraulic pressure $p_D$ is in contact with the underside of sealing element 13 from below and presses or displaces the latter radially outwardly in the direction of inner wall 5 of stator 2. This means that the pressurized hydraulic fluid which is suppliable to control channel 14 switches, presses or moves sealing element 13 into the sealing position.

Figure 4:
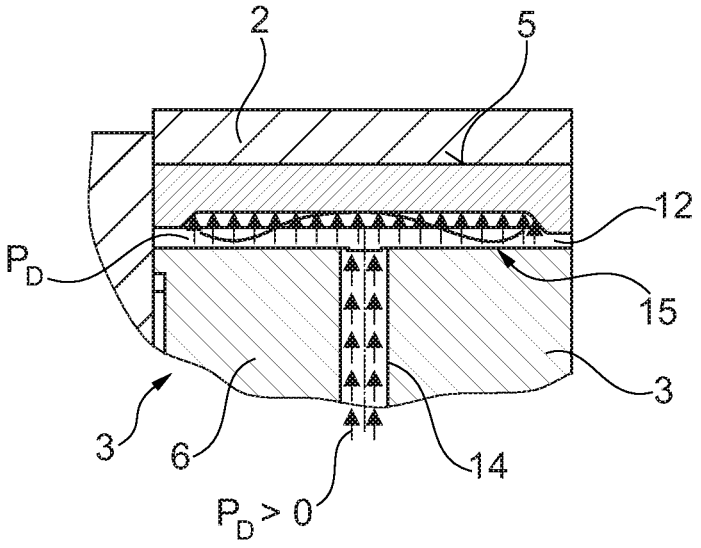
FIG. 4 shows a sectional view of the camshaft adjuster illustrated as a partial detail in FIG. 2 along section line IV from FIG. 2, in which the sealing element is in its sealing position and is pretensioned into the sealing position with the aid of an (optional) spring.

In FIG. 4, which shows a sectional view of camshaft adjuster 1 illustrated as an enlarged partial detail in FIG. 2 along section line IV it is also apparent that sealing element 13 may be alternatively additionally pretensioned into the sealing position with the aid of an optional spring 15. However, this is not absolutely necessary if hydraulic pressure $p_D$ within control channel 14 is sufficiently high.

Figure 5:
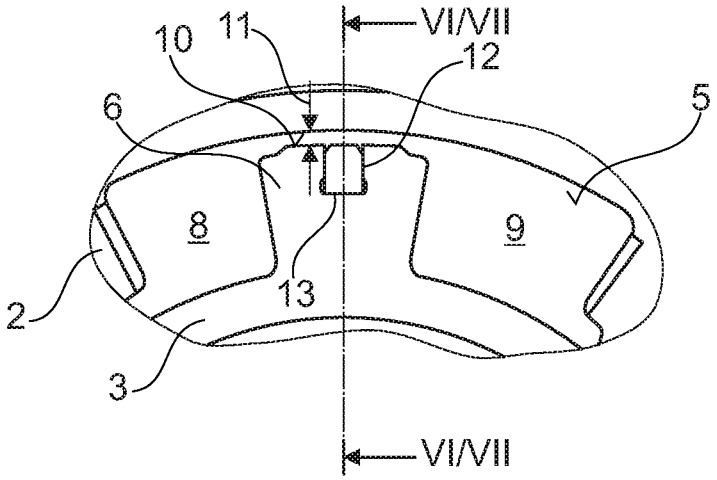
FIG. 5 shows an enlarged partial detail of the camshaft adjuster from FIG. 1, in which the sealing element is in the connecting position.

In FIG. 5, which illustrates an enlarged partial detail of the camshaft adjuster from FIG. 1, sealing element 13 is in another position, namely in a connecting position, in which first and second hydraulic chambers 8 and 9 are fluidically connected to each other or shorted by connecting gap 11. In this connecting position of sealing element 13, the latter is displaced or moved inwardly with respect to the sealing position within rotor vane groove 12 in the radial direction. This means that connecting gap 11 is at least partially released, sealing element 13 being completely accommodated in rotor vane groove 12 in the illustration according to FIG. 5, and connecting gap 11 thus being completely released. In this connecting position, it is possible for rotor 3 to be moved in a defined direction, namely in the direction of a central locking position (not illustrated) of a locking device. A freewheel (not illustrated) is provided for this purpose, which permits a movement of rotor 3 in the preferred direction and blocks it in the opposite direction. This freewheeling function is not illustrated herein. However, it may be implemented, for example, mechanically.

Figure 6:
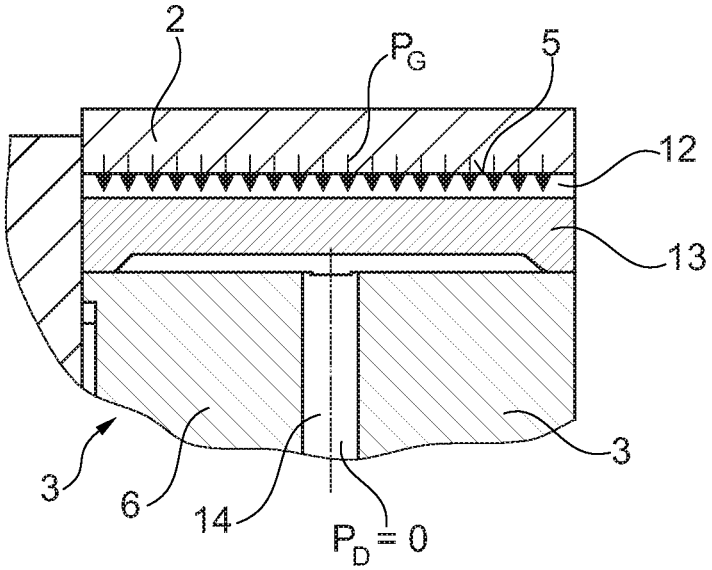
FIG. 6 shows a sectional view of the camshaft adjuster illustrated as a partial detail in FIG. 5 along section line VI, in which the sealing element is in the connecting position.

It is apparent from FIG. 6, which shows a sectional view of the camshaft adjuster illustrated as a partial detail in FIG. 5 along section line VI, that the radial displacement of sealing element 13 within rotor vane groove 12 is effectuated by a hydraulic counter-pressure $p_G$ of a hydraulic fluid, hydraulic counter-pressure $p_G$ being indicated by corresponding arrows in FIG. 6. In FIG. 6, this hydraulic counter-pressure $p_G$ is in contact with an upper side of sealing element 13 from above and presses or displaces the latter radially inwardly in the direction of control channel 14. Hydraulic counter-pressure $p_G$ is effectuated by the pressurized hydraulic fluid situated in hydraulic chambers 8 and 9.

It is also apparent from FIG. 6 that no pressurized hydraulic fluid is supplied to control channel 14 in the illustrated operating state of camshaft adjuster 1, so that a hydraulic pressure $p_D$ does not prevail within control channel 14 and does not act upon the underside of sealing element 13 in FIG. 6. As a result, the pressurized hydraulic fluid situated within hydraulic chambers 8 and 9 switches sealing element 13 into the connecting position or presses or moves the latter away from inner wall 5 of stator 2 within rotor vane groove 12. This operative relationship between hydraulic pressure pp and hydraulic counter-pressure $p_G$ is described in greater detail below.

Figure 7:
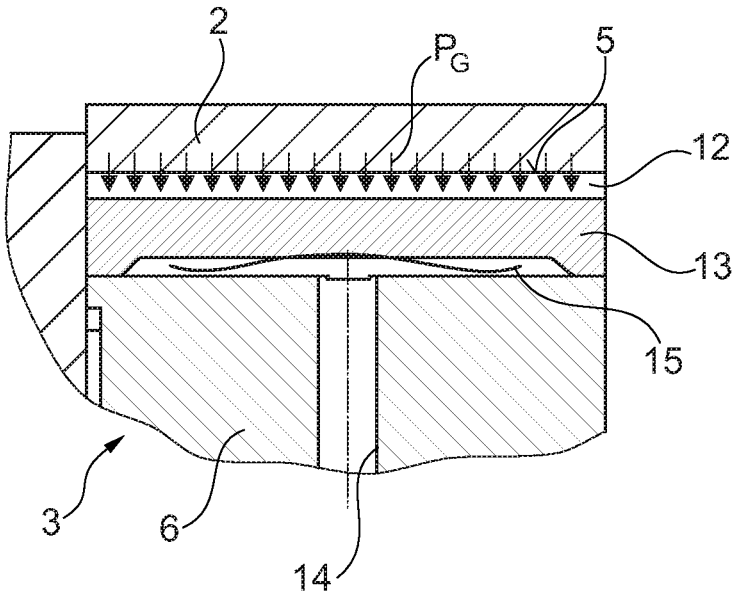
FIG. 7 shows a sectional view of the camshaft adjuster illustrated as a partial detail in FIG. 5 along section line VII, in which the sealing element is in the connecting position and is pretensioned into the sealing position with the aid of the (optional) spring.

In FIG. 7, which shows a sectional view of camshaft adjuster 1 illustrated as an enlarged partial detail in FIG. 5 along section line VII, it is also apparent that sealing element 13 may be alternatively additionally pretensioned into the sealing position with the aid of optional spring 15. In this case, hydraulic counter-pressure $p_G$ induced by the pressurized hydraulic fluid situated in hydraulic chambers 8 and 9 must be selected to be so high that a spring force $F_{Fe}$ acting in the direction of inner wall 5 of stator 2 is able to be overcome. Conversely, spring force $F_{Fe}$ may also be selected in such a way that hydraulic counter-pressure $p_G$ is sufficient for moving sealing element 13 into the connecting position.

The switching between the sealing position and the connecting position of sealing element 13 will now be explained on the basis of FIG. 8, which shows an illustration of the (pressure) force ratios necessary to move sealing element 13 into a sealing position or a connecting position.

Figure 8:
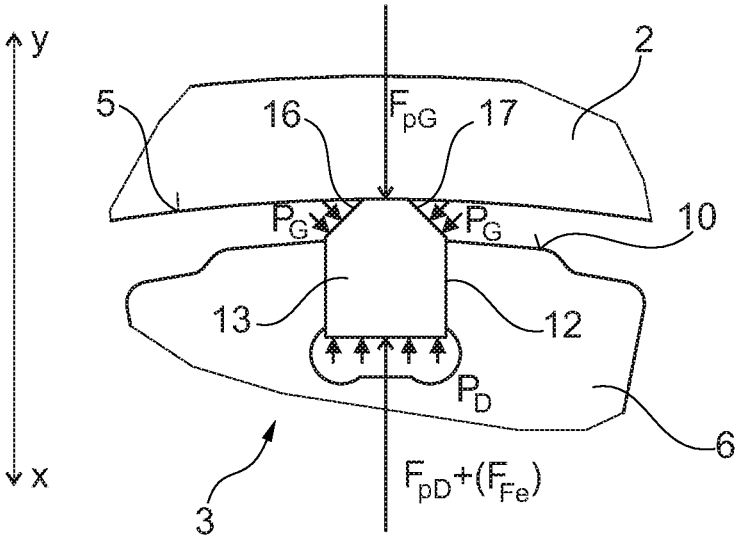
FIG. 8 shows an illustration of the (pressure) force ratios necessary to move the sealing element into the sealing position or the connecting position.

It is apparent in FIG. 8 that a pressure force $F_{pD}$, which is generated by hydraulic pressure $p_D$ within rotor vane groove 12 in control channel 14 (not illustrated herein), engages with the underside of sealing element 13 in FIG. 8. Pressure force $F_{pD}$ thus acts in the direction of inner wall 5 of stator 2 or in the direction of the sealing position of sealing element 13. Optional spring force $F_{Fe}$ is also specified in FIG. 8, the optional presence of this spring force $F_{Fe}$ being indicated by the brackets.

It is furthermore apparent from FIG. 8 that a counter-pressure force $F_{pG}$ engages with the upper side of sealing element 13 in FIG. 8, which is generated by hydraulic counter-pressure $p_G$ prevailing in hydraulic chambers 8 and 9, which acts upon an active surface 16 and 17 assigned to each of hydraulic chambers 8 and 9. Counter-pressure force $F_{pG}$ thus counteracts pressure force $F_{pD}$.

A movement direction x and a movement direction y of sealing element 13 are also indicated by two arrows in FIG. 8. The following force condition applies to a movement of sealing element 13 in the x direction: Counter-pressure force $F_{pG}$>pressure force $F_{pD}$+(optional spring force $F_{Fe}$). The following force condition applies to a movement of sealing element 13 in the y direction: Counter-pressure force $F_{pG}$<pressure force $F_{pD}$+(optional spring force $F_{Fe}$).

Figure 9:
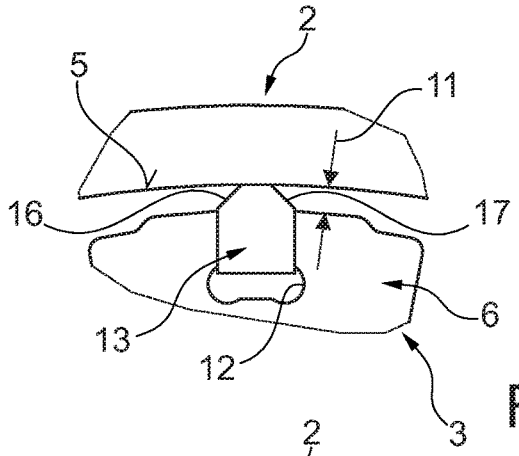
FIG. 9 shows a first specific embodiment of an active surface on the sealing element.

A first specific embodiment of active surfaces 16 and 17 of sealing element 13 is illustrated in FIG. 9. It is apparent that these surfaces are each designed in the form of a chamfer.

Figure 10:
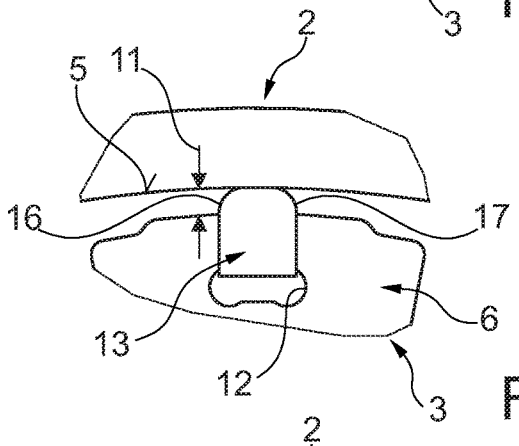
FIG. 10 shows a second specific embodiment of an active surface on the sealing element.

Another, second specific embodiment of active surfaces 16 and 17 of sealing element 13 is illustrated in FIG. 10. It is apparent that these surfaces are each designed in the form of a rounded area.

Figure 11:
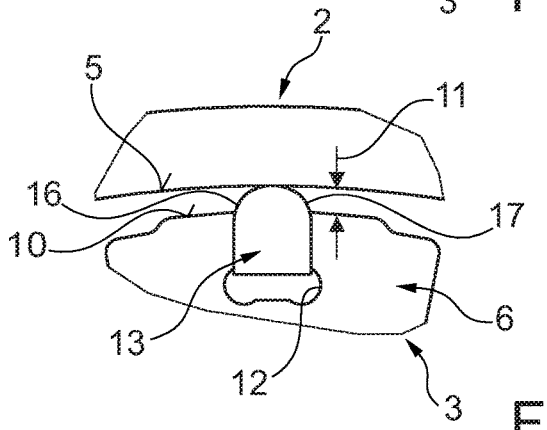
FIG. 11 shows a third specific embodiment of an active surface on the sealing element.

Another, third specific embodiment of active surfaces 16 and 17 of sealing element 13 is illustrated in FIG. 11. It is apparent that the upper side of sealing element 13 is continuously rounded for this purpose.

Figure 12:
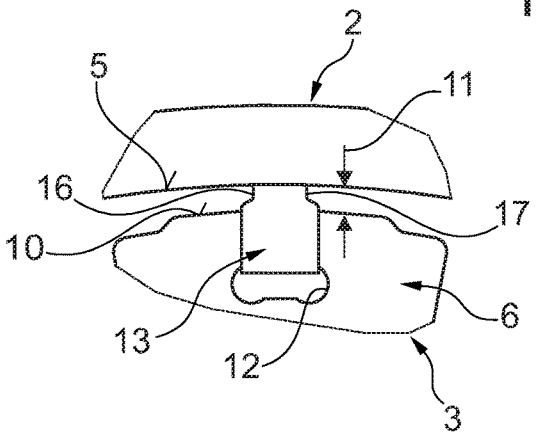
FIG. 12 shows a fourth specific embodiment of an active surface on the sealing element.

Another, fourth specific embodiment of active surfaces 16 and 17 of sealing element 13 is illustrated in FIG. 12. It is apparent that these surfaces are designed in the form of manufacturing-induced, approximately sectional orthogonal bevels.

Figure 13:
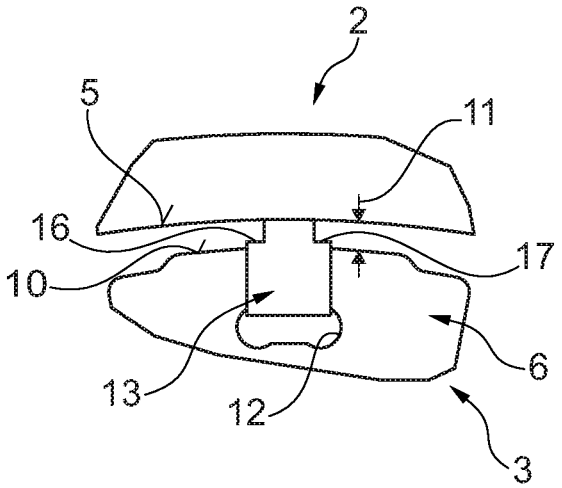
FIG. 13 shows a fifth specific embodiment of an active surface on the sealing element.

Another, fifth specific embodiment of active surfaces 16 and 17 of sealing element 13 is illustrated in FIG. 13. It is apparent that these surfaces are designed in the form of a (single) angular, approximately orthogonal, shoulder on each side of one of the partial vane cells/hydraulic chambers.

LIST OF REFERENCE NUMERALS

1 camshaft adjuster
2 stator
3 rotor
4 large number of separating webs
5 inner wall
6 large number of rotor vanes
7 hub
8 first hydraulic chamber
9 second hydraulic chamber
10 rotor vane end face
11 connecting gap
12 rotor vane groove
13 large number of sealing elements
14 control channel
15 spring
16 active surface
17 active surface
$F_{pD}$ pressure force
$F_{Fe}$ spring force
$F_{pG}$ counter-pressure force
$P_D$ hydraulic pressure
$P_G$ hydraulic counter-pressure

What is claimed is:

1. A camshaft adjuster for an internal combustion engine of a motor vehicle, the camshaft adjuster comprising:

a stator and a rotor accommodated within the stator in a rotatably supported manner, the rotor including at least one rotor vane extending in a radial direction to an inner wall of the stator and forming a first hydraulic chamber and a second hydraulic chamber between the stator and the rotor, a connecting gap remaining between the rotor vane end face and the inner wall of the stator, the connecting gap fluidically connecting the first hydraulic chamber and the second hydraulic chamber; and a sealing element radially movably guided within the rotor vane end face and switchable optionally back and forth between a sealing position, the sealing element resting against the inner wall of the stator, sealing the connecting gap, in the sealing position, and a connecting position, the first and the second hydraulic chambers being connected by the connecting gap in the connecting position.

2. The camshaft adjuster as recited in claim 1 wherein, for the purpose of switching into the sealing position, the sealing element is displaceable in the direction of the inner wall by a pressure force, applicable to the sealing element, of a hydraulic fluid, the hydraulic fluid being optionally suppliable via a control channel.

3. The camshaft adjuster as recited in claim 1 wherein the sealing element is pretensioned in the direction of the sealing position with the aid of a spring.

4. The camshaft adjuster as recited in claim 1 wherein, for the purpose of switching into the connecting position, the sealing element has at least one active surface at the inner wall of the stator, a counter-pressure force of a pressurized hydraulic fluid from the first or the second hydraulic chamber acting upon the at least one active surface.

5. The camshaft adjuster as recited in claim 4 wherein the at least one active surface is dimensioned or geometrically shaped in such a way that the sealing element is displaceable into the connecting position by the counter-pressure force acting upon the active surface during the switching into the connecting position while the rotor is rotating.

6. The camshaft adjuster as recited in claim 4 wherein a hydraulic pressure ($p_D$) of the hydraulic fluid optionally suppliable via a control channel is selected or fixed in such a way that the sealing element is displaceable into the sealing position against the counter-pressure force.

7. The camshaft adjuster as recited in claim 4 wherein the rotor vane end face has a rotor vane groove, the sealing element being radially displaceable by the counter-pressure force into the rotor vane groove, if the counter-pressure force is greater than the pressure force or a spring force.

8. The camshaft adjuster as recited in claim 7 wherein the rotor vane groove is fluidically connected to a control channel.

9. The camshaft adjuster as recited in claim 1 further comprising a lock, the rotor and the stator being rotatably fixedly connectable to each other with aid of the lock.

10. The camshaft adjuster as recited in claim 9 wherein the rotor is movable into a locking position when the sealing element is switched into the connecting position.

* * * * *